US005946525A

United States Patent [19]

Okamura et al.

[11] Patent Number: 5,946,525

[45] Date of Patent: Aug. 31, 1999

[54] IMAGE FORMING APPARATUS

[75] Inventors: Koichiro Okamura; Katsumi Sakamaki, both of Nakai-machi, Japan

[73] Assignee: Fuji Xerox Co., Ltd., Tokyo, Japan

[21] Appl. No.: 09/078,611

[22] Filed: May 14, 1998

[30] Foreign Application Priority Data

Jun. 17, 1997 [JP] Japan ..... 9-160199

[51] Int. Cl.[6] ..... G03G 15/16

[52] U.S. Cl. ..... 399/66; 399/302

[58] Field of Search ..... 399/66, 302, 308, 399/396, 400

[56] References Cited

U.S. PATENT DOCUMENTS

| | | | |
|---|---|---|---|
| 4,183,658 | 1/1980 | Winthaegen | 399/165 |
| 4,541,709 | 9/1985 | Kampschreur | 399/162 |
| 5,390,010 | 2/1995 | Yamahata et al. | 399/308 |
| 5,438,398 | 8/1995 | Tanigawa et al. | 399/302 |
| 5,708,933 | 1/1998 | Nogami et al. | 399/167 |
| 5,799,232 | 8/1998 | Tompkins et al. | 399/167 |

FOREIGN PATENT DOCUMENTS

| | | |
|---|---|---|
| 58-209763 | 12/1983 | Japan . |
| A-4-221974 | 8/1992 | Japan . |
| 7-210008 | 8/1995 | Japan . |
| A-7-239589 | 9/1995 | Japan . |
| 8-314286 | 11/1996 | Japan . |

*Primary Examiner*—Robert Beatty
*Attorney, Agent, or Firm*—Oliff & Berridge, PLC

[57] ABSTRACT

An image forming apparatus is provided in which changes in speed of an intermediate transfer body and a photosensitive body are suppressed and thereby a high quality image without density unevenness, color misalignment, a smear or the like can be formed, and which does not require a larger size in structure, increase in power consumption, a higher degree of complexity and the like. A rubbing contact member, high viscosity damper, magnet, or electromagnetic brake imposes a constant rotation load on the intermediate transfer body. Impulsive and constant changes in speed of the intermediate transfer body and the photosensitive body are suppressed even if changes arise in torque load on the intermediate transfer body and the photosensitive body.

20 Claims, 12 Drawing Sheets

IMAGE FORMING APPARATUS

BACKGROUND OF THE PRESENT INVENTION

1. Field of the Invention

The present invention relates to an image forming apparatus using an intermediate transfer body and more particularly, to an image forming apparatus in which a quality of a recorded image is improved by suppressing changes in speed of an intermediate transfer body and a photosensitive body.

2. Related Prior Art

Conventionally, in an image forming apparatus of an electrophotographic type using an intermediate transfer body in the form of a drum or a belt, a recorded image has been obtained in such a manner that an electrostatic latent image is formed by exposing a photosensitive body in the form of a drum or a belt to light (including laser beam) corresponding to image information, the electrostatic latent image is developed with toner in a developing unit, thereafter a toner image is once transferred to the intermediate transfer body, the toner image on the intermediate transfer body is further transferred to a recording paper and finally the image thus transferred is fixed on the recording paper in a fixing unit. There has been known a so-called transfix type image forming apparatus in which transfer and fixing of a toner image on an intermediate transfer body to a recording paper are simultaneously conducted.

In the mean time, in such an image forming apparatus, a recording paper has been passed between an intermediate transfer body and a transfer roller or a transfer/fixing roller to transfer a toner image on the intermediate transfer body onto a recording paper in order to realize a high speed operation when an electrostatic latent image is formed on a photosensitive body or the toner image, developed using toner, on the photosensitive body is transferred to the intermediate transfer body. Therefore, though it is preferred that no changes in speed of the intermediate transfer body and photosensitive body occur in order to obtain a good image, there arise impulsive changes in speed of the intermediate transfer body and the photosensitive body since impulsive changes in torque load on the intermediate transfer body and the photosensitive body occur due to various causes later described.

For example, when a leading edge or the following edge of a recording paper passes between an intermediate transfer body and a transfer roller or a transfer/fixing roller, a impulsive change arises in torque load of the intermediate transfer body.

In the case where a distance between a transfer unit and a fixing unit is shorter than a length of a recording paper, a shock which arises when a leading edge of the recording paper moves into the fixing unit is transmitted to an intermediate transfer body through the recording paper to cause an impulsive change in torque load of the intermediate transfer body.

In addition, when a cleaning blade, a cleaning roller or the like, which is used to remove toner on the intermediate transfer body or the photosensitive body, gets contacted with and rubbed or moved away from the surface of the intermediate transfer body or the photosensitive body, an impulsive change in torque load affects the intermediate transfer body or the photosensitive body.

Furthermore, a change in speed of a motor which drives the intermediate transfer body or the photosensitive body, and gears out of mesh with which a driving force of a motor is transmitted to the intermediate transfer body or the photosensitive body or the like, cause constant speed changes in the bodies.

As described above, if an impulsive change in torque load of the intermediate transfer body or the photosensitive body occurs, degradation in image quality arises as described below. For example, when a recording paper moves into or move out of a space between an intermediate transfer body and a transfer roller in a process of forming an electrostatic latent image on a photosensitive body, a impulsive change in torque load of the intermediate transfer member is brought about, which in turn results in an impulsive change in speed of the intermediate transfer body, which then causes an impulsive change in speed of the photosensitive body as well. As a result, a disturbance in a latent image on the photosensitive body arises, which causes the latent image affected by the disturbance to suffer from a density unevenness in a toner image produced by toner-developing. In a so-called color image forming apparatus of a tandem type, in which a plurality of photosensitive bodies for respectively forming toner images in various colors are provided along an intermediate transfer body and a toner image in each color is sequentially transferred on the intermediate transfer body, the toner images in different colors have poor overlaying alignment in forming a color image (hereinafter referred to as color misalignment) In addition to this, in the case where a distance between a transfer unit and a fixing unit is shorter than a length of a recording paper, a shock which arises when a leading edge of the recording paper moves into the fixing unit is transmitted to an intermediate transfer body through the recording paper to cause a change in speed of the intermediate transfer body, so that a smear is produced on a toner image on the recording paper.

As conventional image forming apparatuses to suppress a change in speed of an intermediate transfer body and the photosensitive body which are causes for density unevenness, color misalignment or a smear, there are disclosed such apparatuses in, for example, Japanese Published Unexamined Patent Application Nos. Hei 4-221974 and Hei 7-239589.

An image forming apparatus disclosed in Japanese Published Unexamined Patent Application No. Hei 4-221974 comprises a fly-wheel mounted at one end of a drive roller for driving a belt-like intermediate transfer body in order to increase an inertia associated with the body and thereby a change in speed of the intermediate transfer body does not occur.

An image forming apparatus disclosed in Japanese Published Unexamined Patent Application No. Hei 4-239589 comprises a frictional member contacting with and rubbing a photosensitive body drum and thereby a torque load is constantly imposed on the photosensitive body drum.

However, according to the conventional image forming apparatus disclosed in Japanese Published Unexamined Patent Application No. Hei 4-221974, a large size fly-wheel is required in order to prevent a large impulsive change in speed of the intermediate transfer body which occurs when a recording paper moves into or moves out of a space between the intermediate transfer body and a transfer roller and thus there arise problems such as increase in an apparatus's size, increase in power consumption, and the like.

In addition, according to the conventional image forming apparatus disclosed in Japanese Published Unexamined Patent Application No. Hei 7-239589, since, if the invention was applied to a color image forming apparatus of a tandem type the frictional member, a frictional member would be employed for contact and friction in each of photosensitive body drums for various colors, there would arise a structural problem that the image forming apparatus would come to have a complex structure. A change in speed of the intermediate transfer body which occurs when a recording paper moves into or moves out of a space between the intermediate transfer body and a transfer roller cannot sufficiently be prevented since the frictional member installed on the photosensitive body drum is an indirect countermeasure.

SUMMARY OF THE INVENTION

It is, accordingly, an object of the present invention to provide an image forming apparatus in which changes in speed of an intermediate transfer body and a photosensitive body are suppressed and thereby a high quality image without density unevenness, color misalignment, a smear or the like can be formed.

It is another object of the present invention to provide an image forming apparatus which does not require a larger size in structure, increase in power consumption, a higher degree of complexity and the like.

The present invention provides in order to achieve the above described objects an image forming apparatus, which comprises: an image carrier; electrostatic latent image forming means for forming an electrostatic latent image on the surface of the image carrier; developing means for developing the electrostatic latent image formed on the image carrier with toner to form a toner image; an intermediate transfer body rotatably supported; drive means for driving the intermediate transfer body; transfer means for transferring the toner image to the intermediate transfer body; transferring/fixing means for transferring the toner image transferred on the intermediate transfer body to a recording medium to fix the image on the medium; and rotation load imposing means for imposing a constant rotation load to the intermediate transfer body or the drive means to suppress a change in speed of the intermediate transfer body.

DETAILED DESCRIPTION OF THE INVENTION

Figure 1:
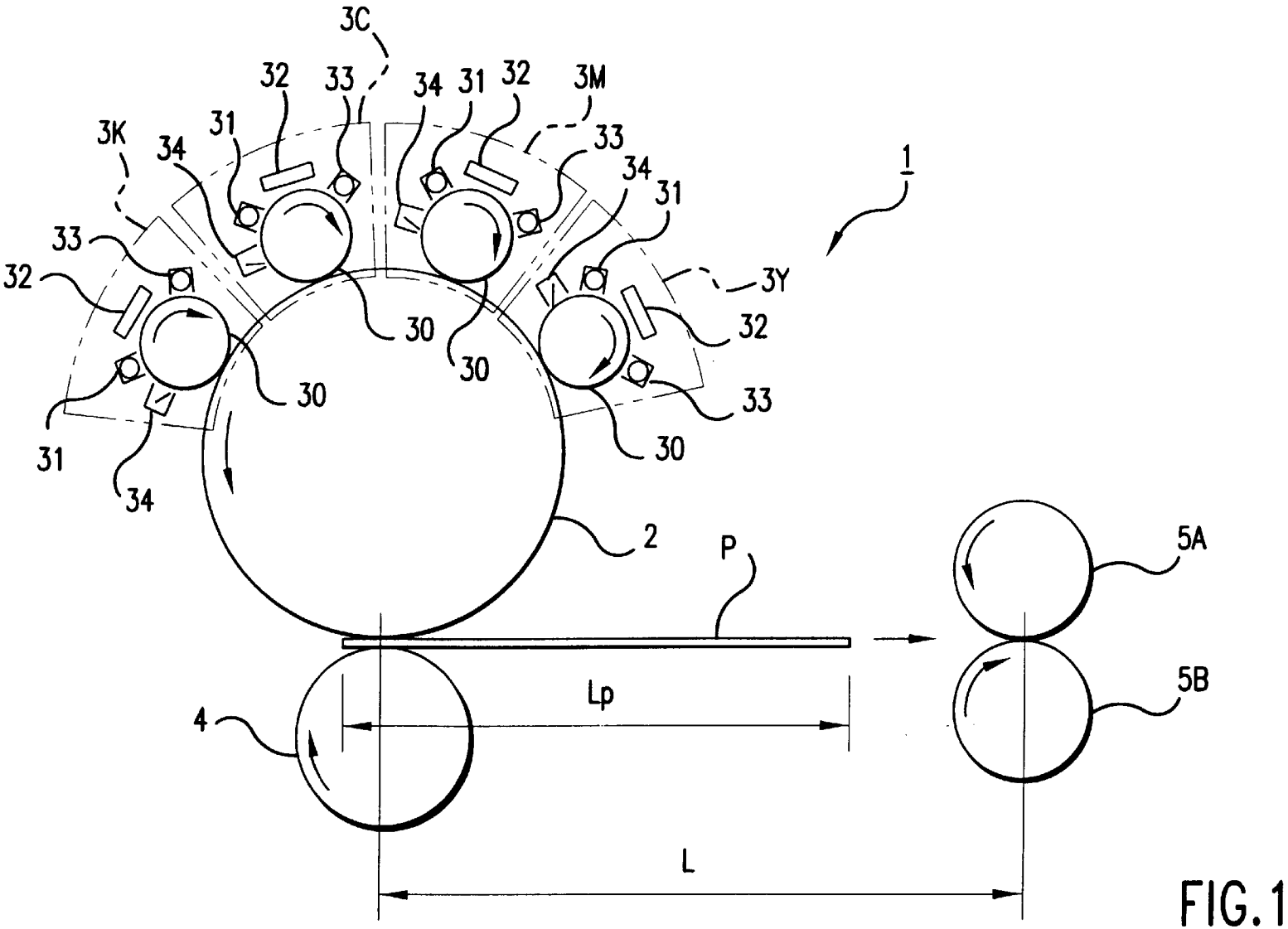
FIG. 1 is a view showing a structure of an image forming apparatus according to a first embodiment of the present invention.

FIG. 1 shows an image forming apparatus according to a first embodiment of the present invention. The image forming apparatus 1 comprises: an intermediate transfer body 2 in the shape of a drum which rotates along a direction arrow in the figure; image forming units 3Y, 3M, 3C, 3K for respectively transferring toner images in colors of yellow (Y), magenta (M), cyan (C), black (B) to the intermediate transfer body 2, disposed along the periphery of the intermediate transfer body 2 in the form of an arc; a transfer roller 4 for transferring a color toner image transferred on the intermediate transfer body 2 to a recording paper P; and a pair of fixing rollers 5A, 5B for fixing the color toner image transferred on the recording paper P, the fixing rollers being disposed at a distance L from the transfer roller 4 longer than a length Lp of the recording paper P in a transporting direction thereof.

The image forming units 3Y, 3M, 3C, 3K respectively comprise: a photosensitive body 30 in the shape of a drum which rotates along a direction of an arrow in the figure; an electric charger 31 for charging an electricity on the surface of the photosensitive body 30 in a uniform manner; an exposure unit 32 for exposing the surface of the photosensitive body 30, which is charged in a uniform manner, to a laser beam modulated on the basis of one of image data in Y, M, C, K from an image processing section not shown to form an electrostatic image; a developing device 33 for developing the electrostatic latent image formed on the surface of the photosensitive body 30 with any of the toner in Y, M, C, K; and a cleaner 34 for removing the toner left behind on the surface of the photosensitive body 30.

The transfer roller 4 is pressed to the intermediate transfer body 2 by a pressure of a required magnitude for transfer, is applied with a bias voltage of a reverse polarity to a charge polarity of the color toner image, and the color toner image held on the intermediate transfer body 2 is electrostatically transferred to the recording paper P.

Figure 2:
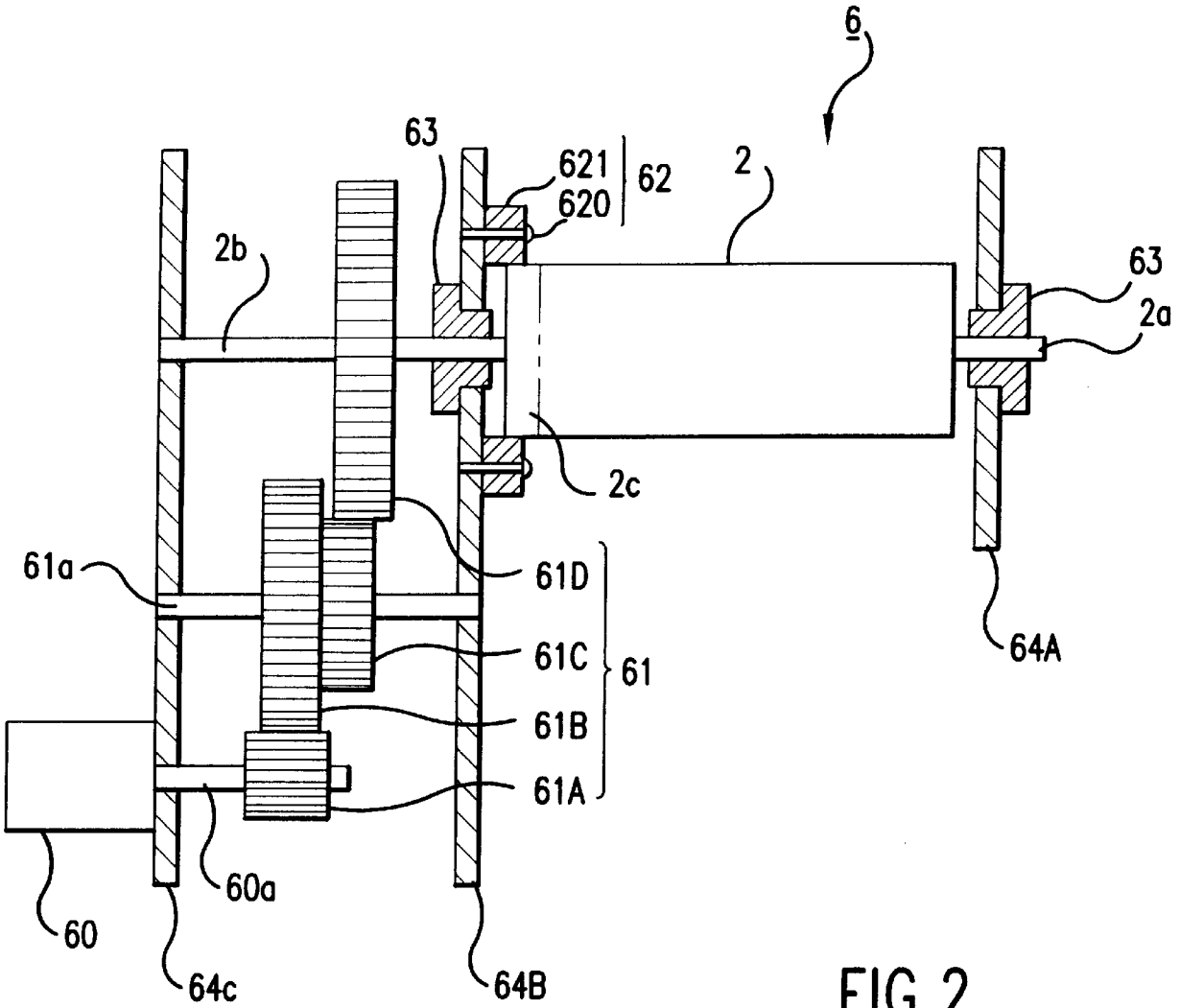
FIG. 2 is a view showing rotation load imposing means according to the first embodiment.

FIG. 2 shows a drive system for the intermediate transfer body 2. The driving system 6 comprises: a motor 60; a gear group 61 for transmitting a drive torque of the motor 60 to the intermediate transfer body 2; and rotation load imposing means 62 for imposing a constant rotation load to the intermediate transfer member 2. The intermediate transfer body 2 comprises shafts 2*a*, 2*b* protruding at both ends thereof, which shafts 2*a*, 2*b* are rotatably supported by supporting plates 64A, 64B with bearings 63, 63 mounted therein. The gear group 61 comprises: a gear 61A fixedly held by an output shaft 60*a* of the motor 60, gears 61B, 61C fixedly held by an intermediate shaft 61*a* rotatably mounted between the supporting plates 64B, 64C; and a gear 61 D fixedly held by the shaft 2*b* of the intermediate transfer body 2. The rotation load imposing means 62 is fixed to the supporting plate 64B by a screw 620 and composed of a rubbing contact member 621 in the shape of a ring constantly rubbing and contacting to a non-image forming portion 2*c* on the intermediate transfer body 2. The rubbing contact member 621 is in a rubbing and contact condition with the intermediate transfer body 2 by the non-image forming portion 2*c* thereon to impose a constant rotation load on the intermediate transfer body 2. The rotation load imposing means 62 does not require a power source, whereby low cost and power saving can be realized.

Figure 3A:
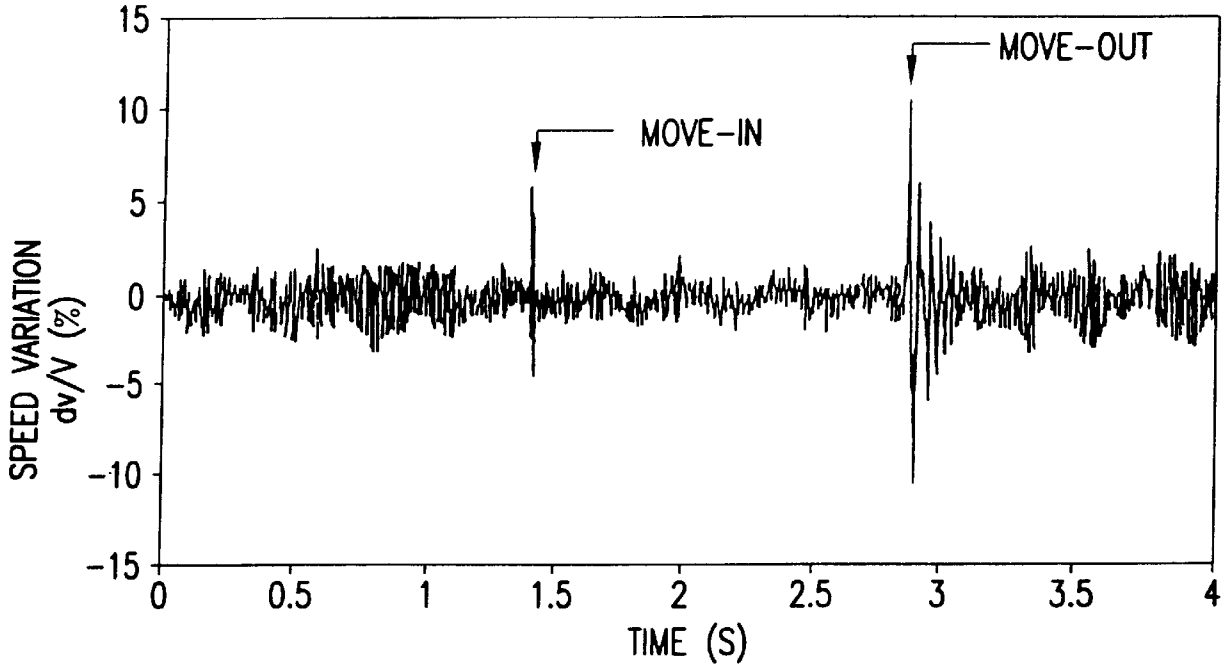
FIG. 3(*a*) is a view showing a change in speed of an intermediate transfer body when a rotation load is not imposed thereon and FIG. 3(*b*) is a view showing a change in speed of an intermediate transfer member when a rotation load is imposed thereon.
Figure 3B:
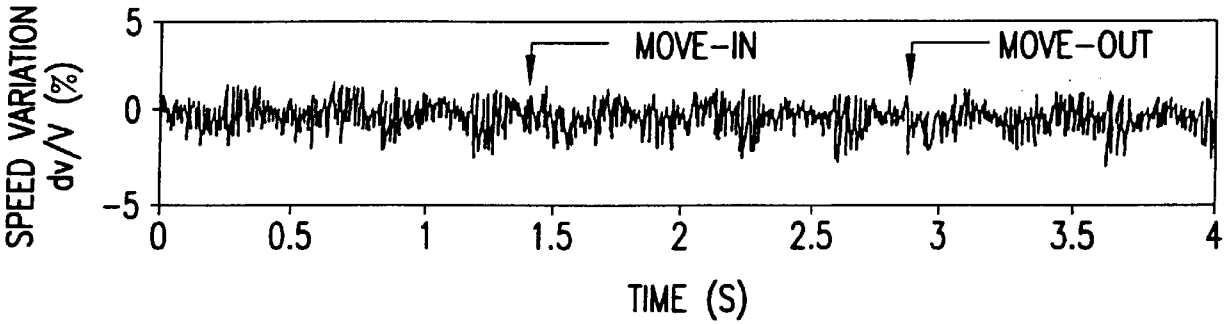

FIG. 3(*a*) shows a speed variation dv/V (%) of the intermediate transfer body 2 without rotation load imposing means 62, FIG. 3(*b*) shows a speed variation of the intermediate transfer body with rotation load imposing means 62. As can be seen from FIGS. 3(*a*) and 3(*b*), a speed variation without a constant rotation load on the intermediate transfer body 2 shows about 6% when a recording paper P moves in a second transfer region and about 11% when the recording paper moves out of the second transfer region, while a speed variation with a constant rotation load imposed, as is in the above described embodiment, can be suppressed to about 2% both when the recording paper moves in and out. Besides, a speed variation can be suppressed in an ordinary operation other than when the recording paper moves in or out. Therefore, a high quality image without density unevenness, color misalignment, a smear or the like therein can be produced.

Figure 4:
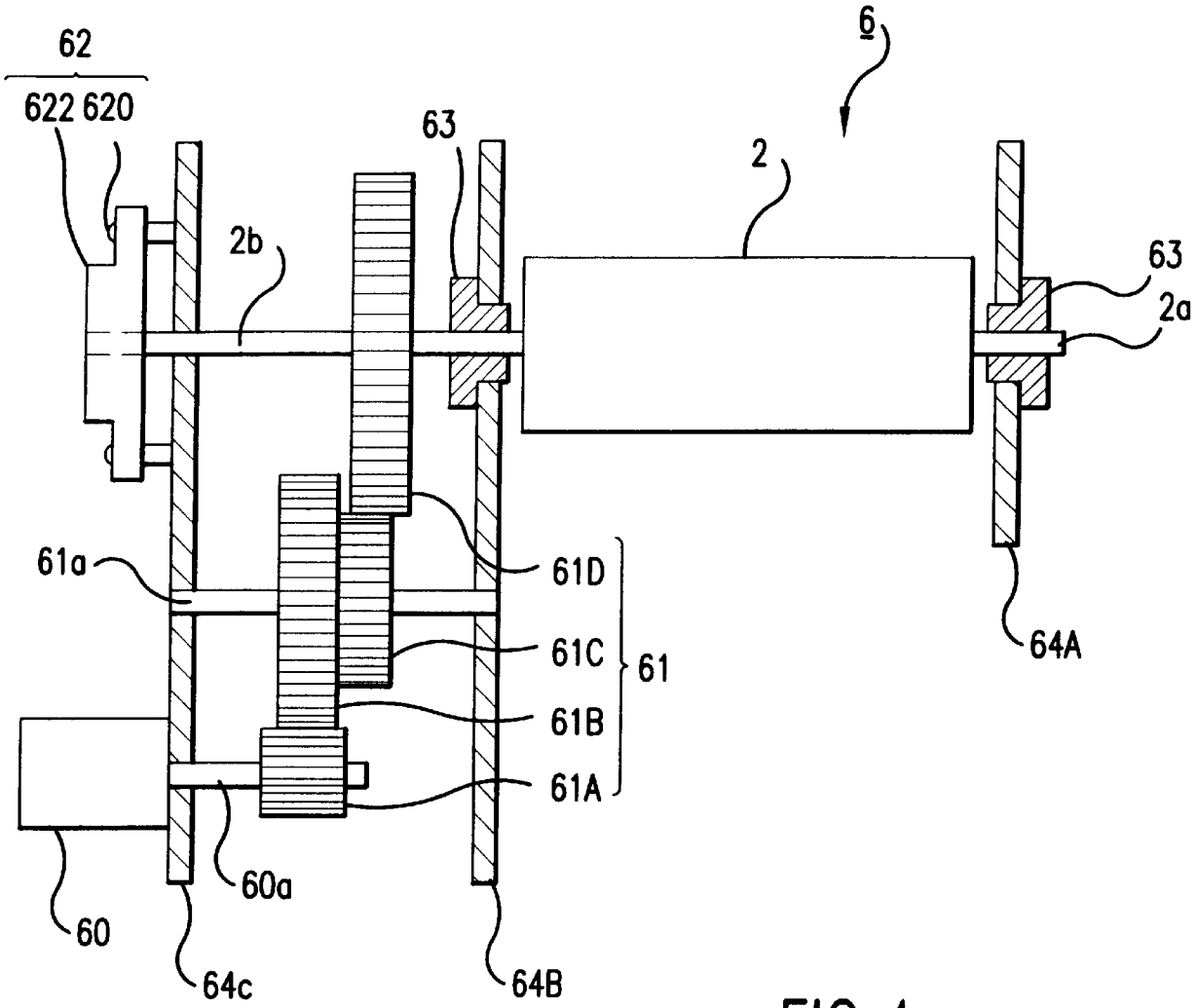
FIG. 4 is a view showing rotation load imposing means according to a second embodiment.

FIG. 4 shows a drive system of the intermediate transfer body 2 according to a second embodiment of the present invention. The drive system 6 of the second embodiment is different from the first embodiment only in the rotation load imposing means 62 and the other constituents are same. The rotation load imposing means 62 of the second embodiment is held to a supporting plate 64C with a screw 620 and the means 62 comprises a high viscosity damper 622 to impose a constant rotation load on a shaft 2*b* of the intermediate transfer body 2. According to the second embodiment, a constant rotation load is imposed on the shaft 2*b* of the intermediate transfer body 2 by viscosity which the high viscosity damper 622 has, whereby a similar effect to the one of the first embodiment can be attained.

Figure 5:
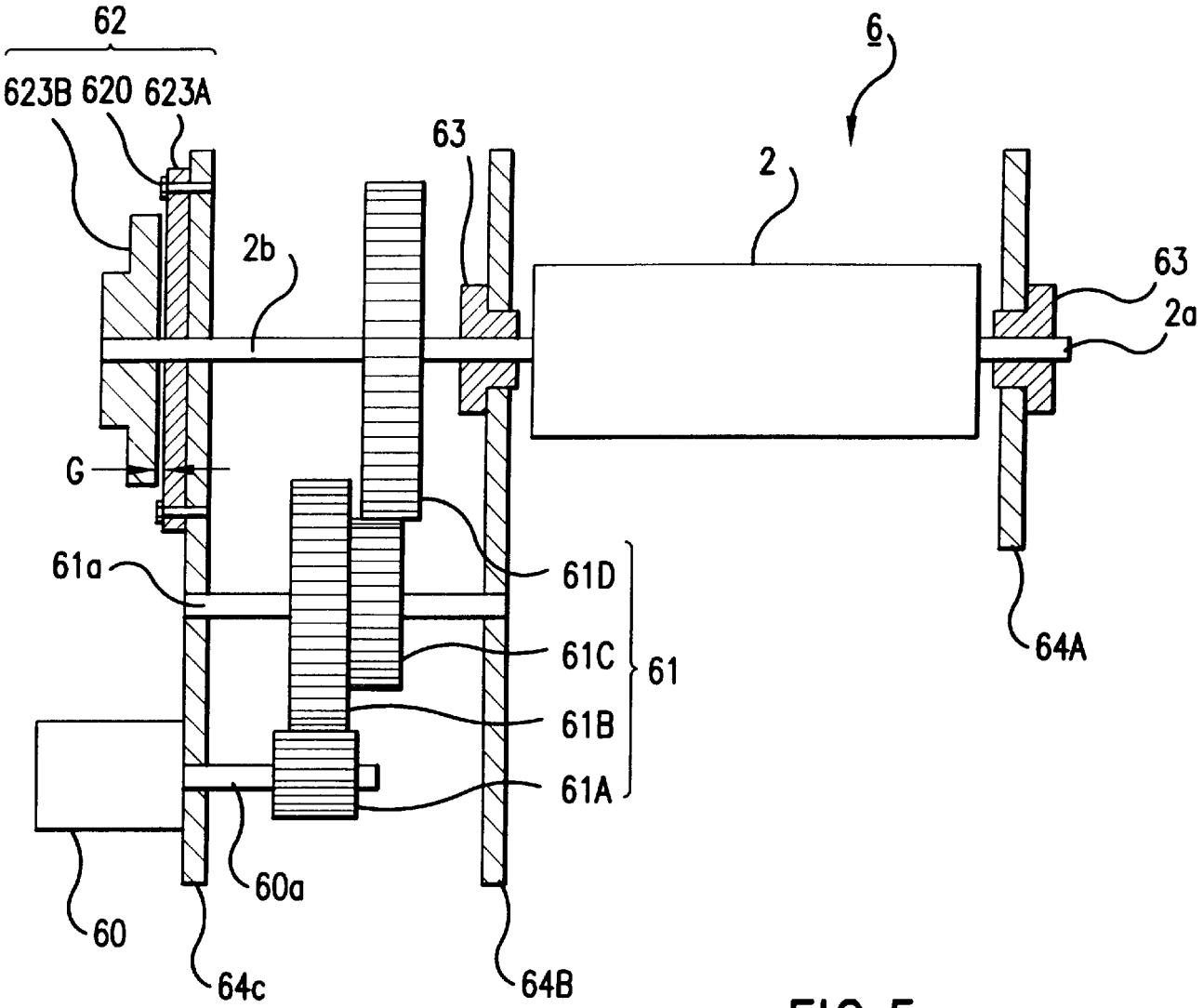
FIG. 5 is a view showing rotation load imposing means according to a third embodiment.

FIG. 5 shows a drive system of the intermediate transfer body 2 according to a third embodiment of the present invention. The drive system 6 of the third embodiment is different from the first embodiment only in the rotation load imposing means 62 and the other constituents are same. The rotation load imposing means 62 of the third embodiment comprises: a stationary magnetic member 623A fixedly held to a supporting plate 64C by a screw 620; and a rotary magnetic member 623B fixedly held to a shaft 2*b* of the intermediate transfer body 2 so as to keep a given gap G between the stationary and rotary magnetic members 623A, 623B. The stationary and rotary magnetic members 623A, 623B may be combinations of a magnet and an iron plate or of an iron plate and a magnet, or of magnets whose opposed surfaces respectively have the same polarities or different polarities. According to the third embodiment, a constant rotation load is imposed on the shaft 2*b* of the intermediate transfer body 2 by a magnetic force acting between the stationary and rotary magnetic members 623A, 623B, whereby a similar effect to the one of the first embodiment can achieved.

Figure 6:
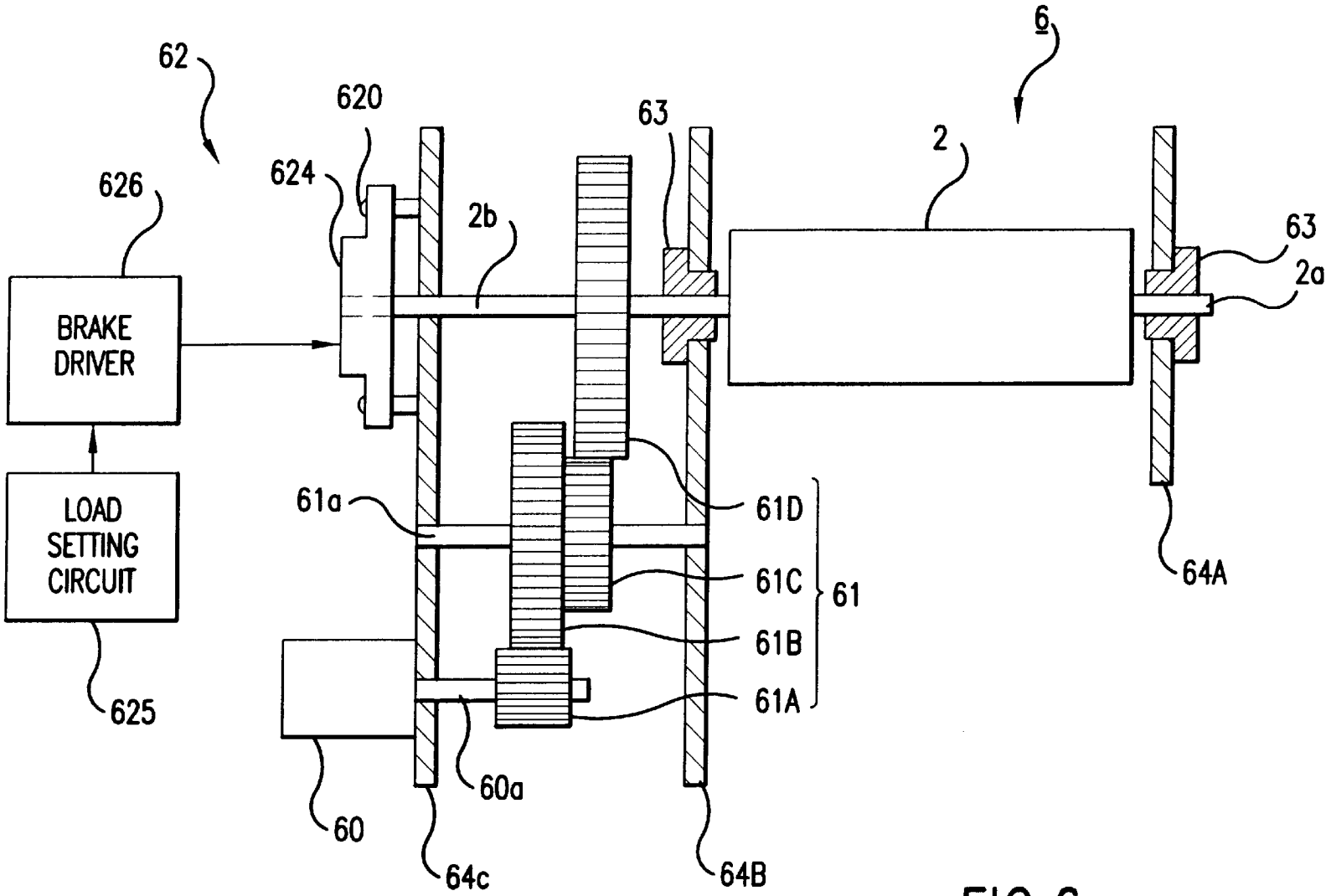
FIG. 6 is a view showing rotation load imposing means according to a fourth embodiment.

FIG. 6 shows an intermediate transfer body 2 according to a fourth embodiment of the present invention. The drive system 6 of the fourth embodiment is different from the first embodiment only in the rotation load imposing means 62 and the other constituents are same. The rotation load imposing means 62 of the fourth embodiment is fast held to a supporting plate 64C with a screw 620 and the means 62 comprises: an electromagnetic brake 624 to impose a constant rotation load on a shaft 2*b* of the intermediate transfer body 2; a load setting circuit 625 for setting a rotation load imposed on the shaft 2*b* of the intermediate transfer body 2 by the electromagnetic brake 624; and a brake driver 626 for controlling the electromagnetic brake 324 on the basis of an output of the load setting circuit 625. According to the fourth embodiment, a constant rotation load is imposed on the shaft 2*b* of the intermediate transfer body 2 by a braking force of the electromagnetic brake 624, a change in speed of the intermediate transfer body 2 can be suppressed as is in the first embodiment and a rotation load imposed on the intermediate transfer body 2 can be adjusted by a change in setting of the load setting circuit 625 with ease.

Figure 7:
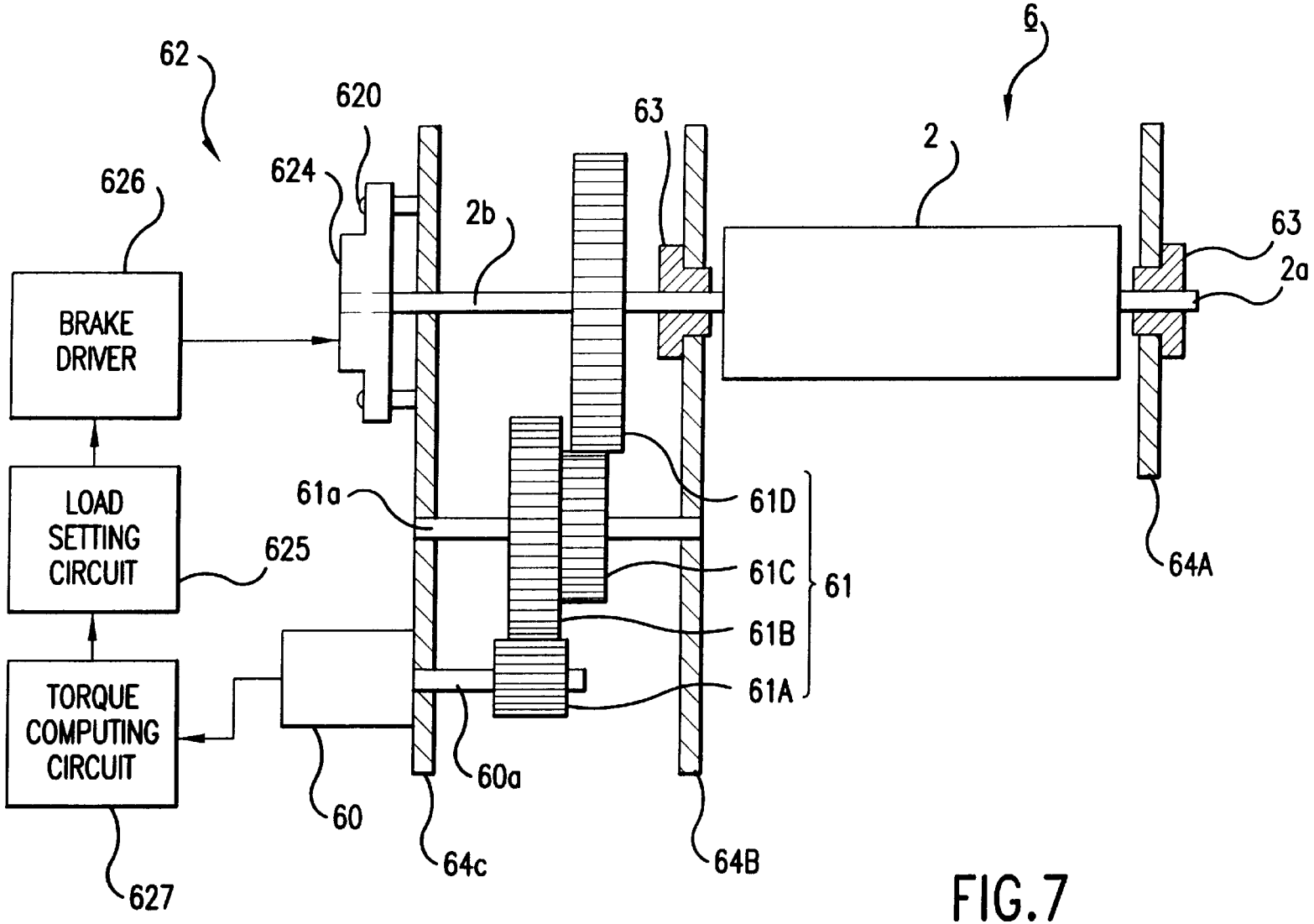
FIG. 7 is a view showing rotation load imposing means according to a fifth embodiment.

FIG. 7 shows a drive system of a intermediate transfer body according to a fifth embodiment of the present invention. The drive system 6 of the fifth embodiment is a drive system that the rotation load imposing means 62 of the fourth embodiment is added with a torque computing circuit 627 and the other constituents are same. The torque computing circuit 627 computes a torque load of the intermediate transfer body 2 from a drive current of the motor 60 at a predetermined time, further computes to obtain a change in torque from the computation result of the torque load, still further computes a constant load Tc which satisfies a relation of Tc>Tmax on the maximum Tmax of an absolute value of the computed change in torque and then outputs the constant load Tc to the load setting circuit 625. According to the fifth embodiment, if the torque computing circuit 627 computes a constant load Tc from a drive current of the motor 60, the load setting circuit 625 sets a rotation load to be imposed to the intermediate transfer body 2 based on the constant load Tc computed by the torque computing circuit 627, the brake driver 626 controls the electromagnetic brake 624 based on an output of the load setting circuit 625, a constant rotation load is imposed to the shaft 2*b* of the intermediate transfer body 2 by a braking force of the electromagnetic brake 624, thereby a change in speed of the intermediate transfer body 2 can be suppressed in a similar manner to the first embodiment, and a rotation load to be imposed to the intermediate transfer body 2 can automatically be set.

Figure 8:
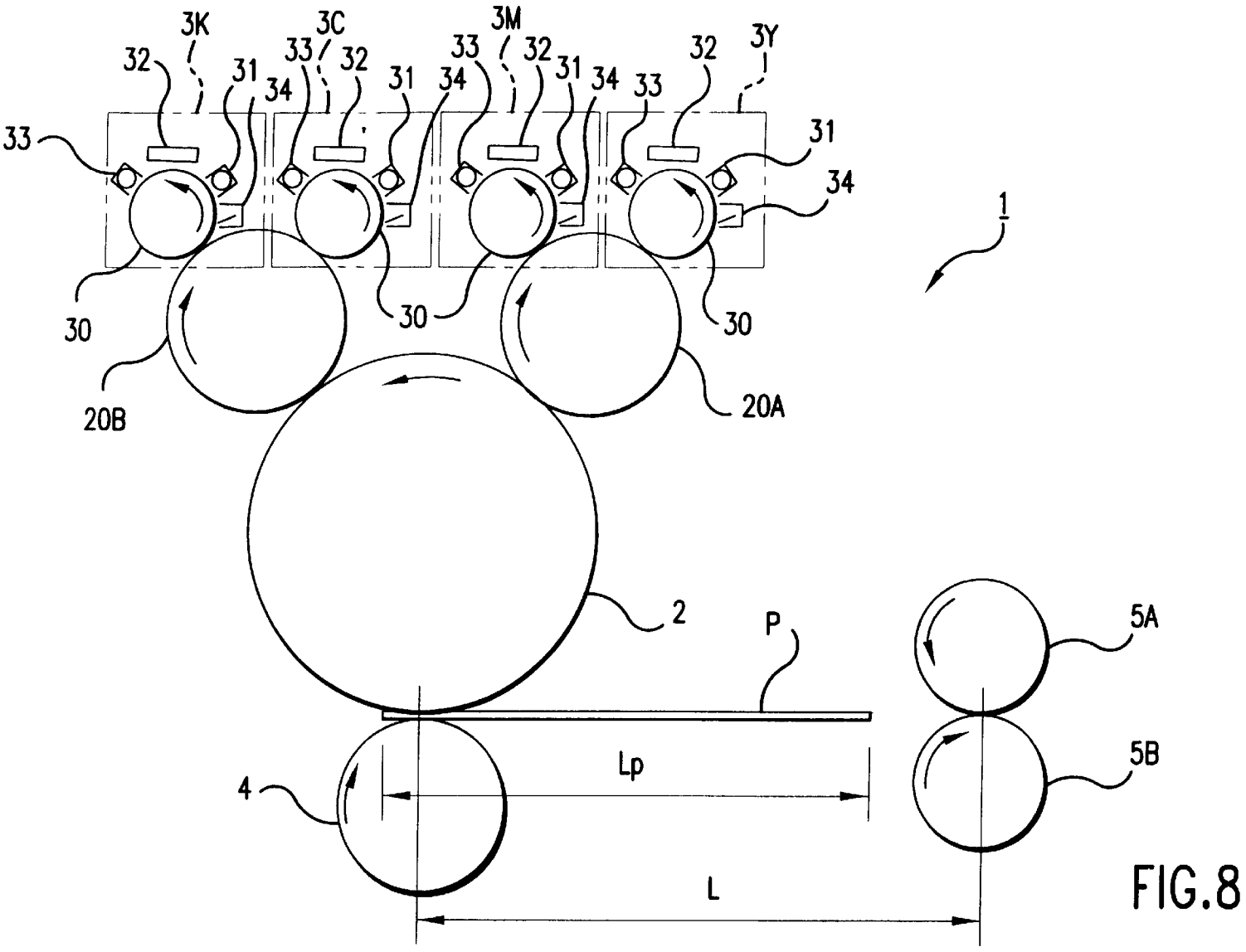
FIG. 8 is a view showing a structure of an image forming apparatus according to a sixth embodiment of the present invention.

FIG. 8 shows a sixth embodiment of the present invention. The image forming apparatus 1 is an image forming apparatus set forth in the image forming apparatus 1 of the first embodiment, wherein two intermediate transfer bodies 20A, 20B in the shape of a drum which respectively hold toner images of two colors are disposed along the periphery of an intermediate transfer body 2, image forming units 3Y, 3M, 3C, 3K are disposed in a linear manner and the apparatus comprises rotation load imposing means as shown in the first to fifth embodiments which imposes a constant rotation load on the intermediate transfer body 2 and the other constituents are same as those in the first embodiment. According to the sixth embodiment, a similar effect to the one of the first embodiment can be attained.

Figure 9:
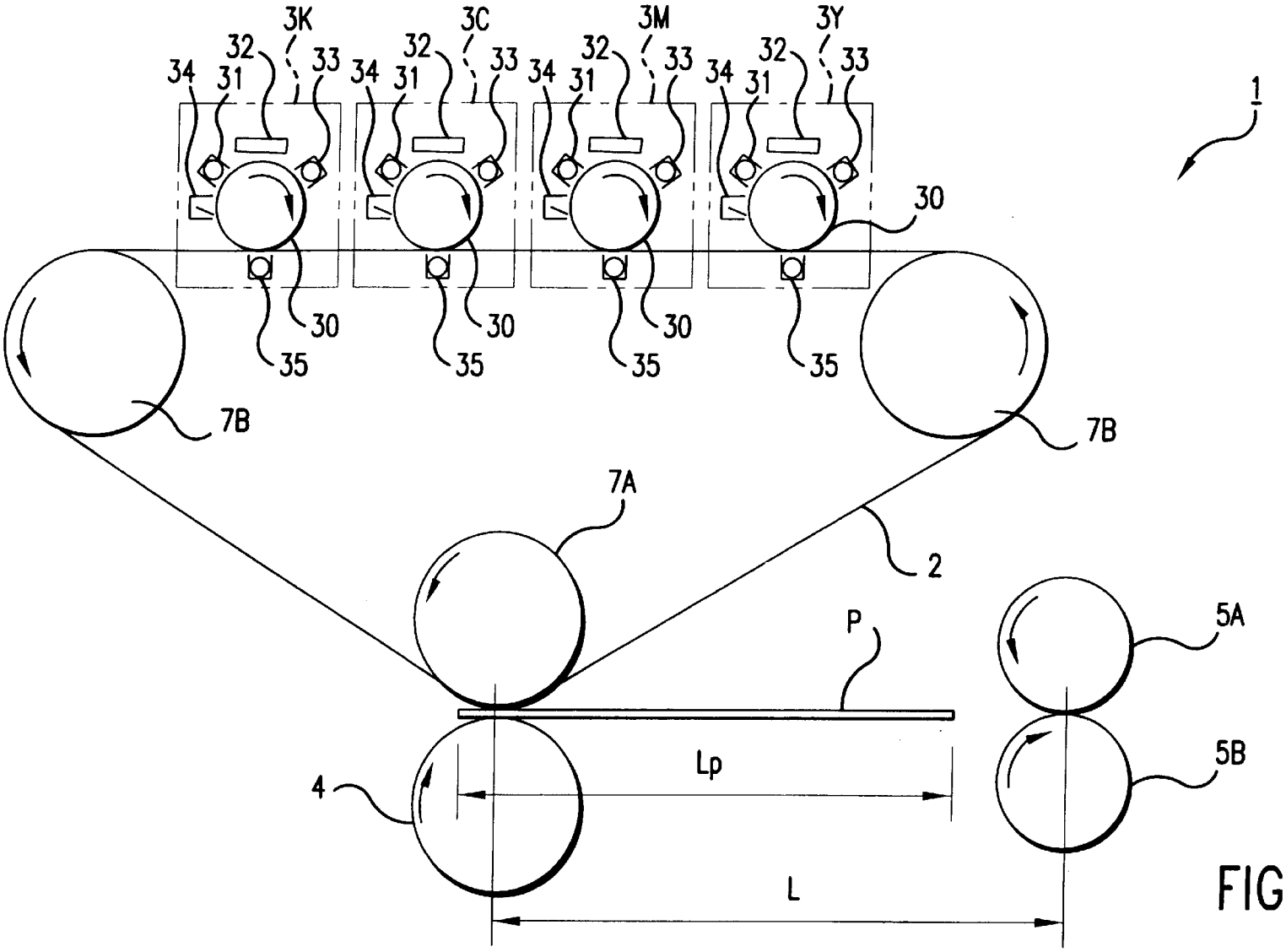
FIG. 9 is a view showing a structure of an image forming apparatus according to a seventh embodiment of the present invention.

FIG. 9 shows a seventh embodiment of the present invention. The image forming apparatus 1 is an image forming apparatus set forth in the image forming apparatus 1 of the first embodiment, wherein the apparatus comprises: an intermediate transfer body 2 in the shape of a belt instead of the one of in the shape of a drum; a drive roller 7A and a driven roller 7B, between which the intermediate transfer body 2 in the shape of a belt is extended; a transfer corotron 35 for transferring a toner image on a photosensitive body 30 to the intermediate transfer body 2 in the shape of a belt on each of the image forming units 3Y, 3M, 3C, and 3K; and rotation load imposing means as shown in the first to fifth embodiments for constantly imposing a rotation load to the drive roller 7A. According to the seventh embodiment, a similar effect to the one of the first embodiment can be achieved.

Figure 10:
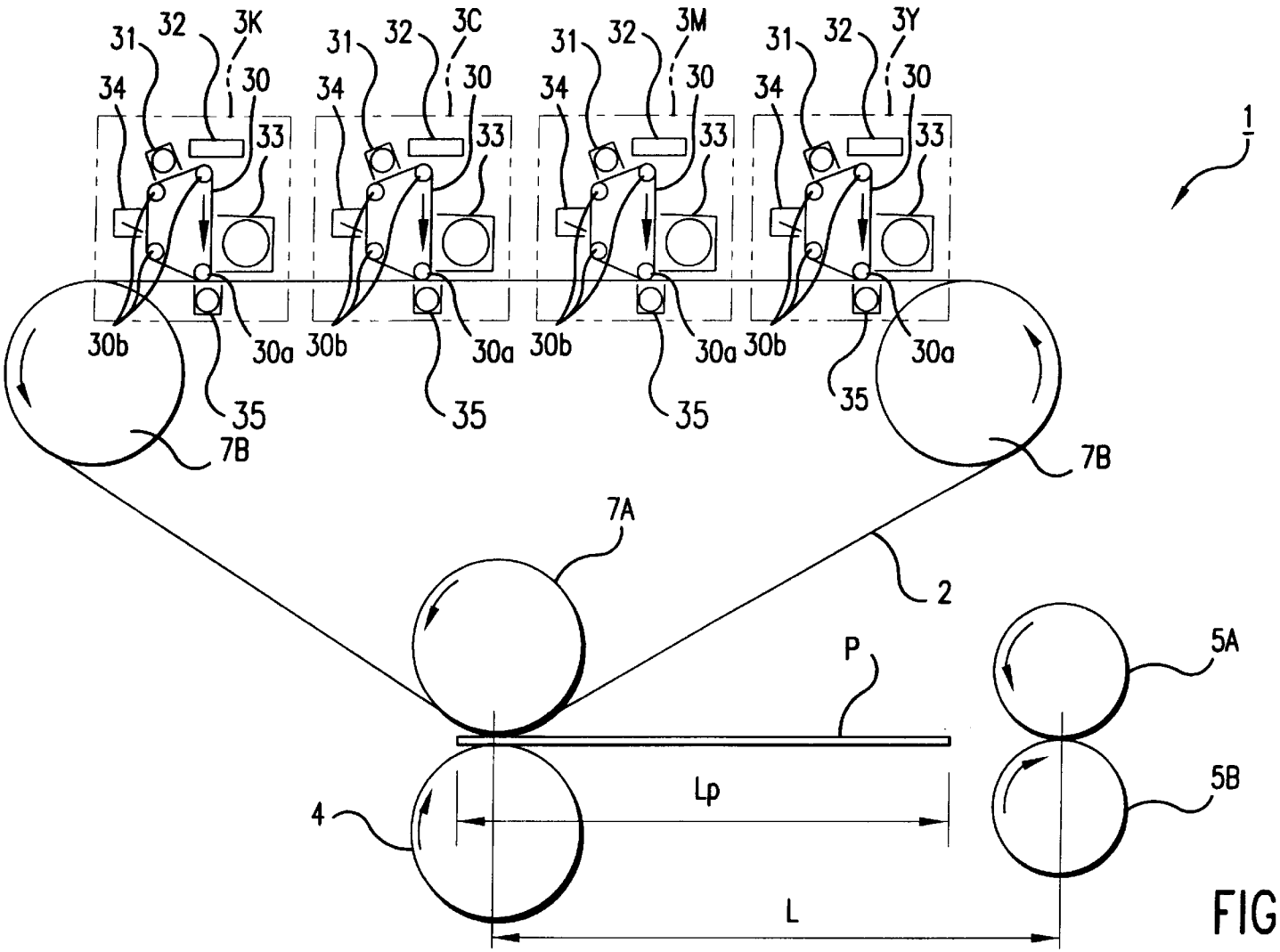
FIG. 10 is a view showing a structure of an image forming apparatus according to an eighth embodiment of the present invention.

FIG. 10 shows an eighth embodiment of the present invention. The image forming apparatus 1 is an image forming apparatus set forth in the image forming apparatus 1 of the seventh embodiment, wherein the image forming apparatus comprises: a photosensitive body 30 in the shape of a belt instead of that the one in the shape of a drum; and a drive roller 30*a* and a driven roller 30*b*, between which the photosensitive body 30 in the shape of a belt is extended, and the other constituents are same as those of the seventh embodiment. According to the eighth embodiment, a similar effect to the one of the seventh embodiment can be achieved.

Figure 11:
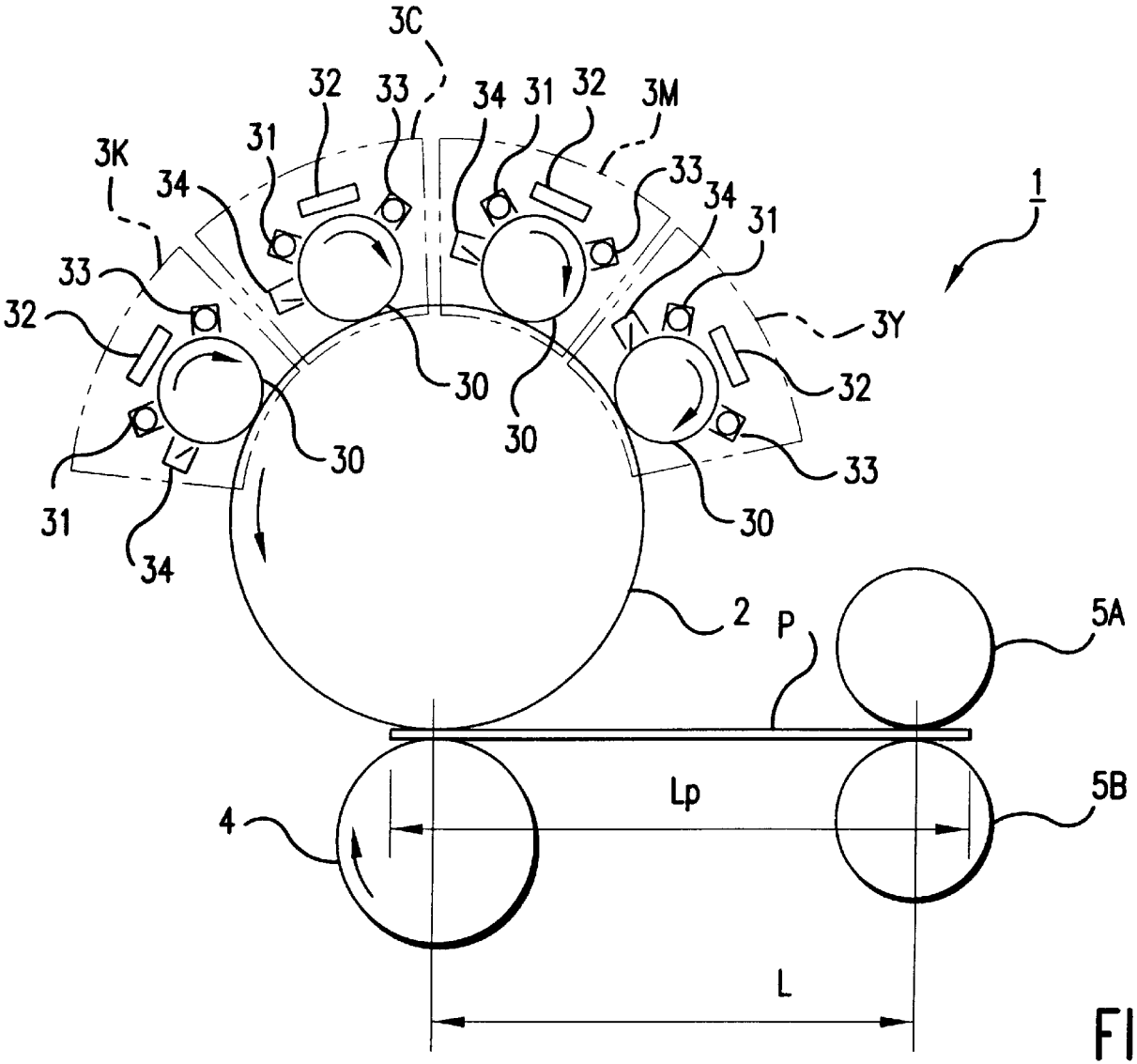
FIG. 11 is a view showing a structure of an image forming apparatus according to a ninth embodiment of the present invention.

FIG. 11 shows a ninth embodiment of the present embodiment. The image forming apparatus 1 is an image forming apparatus set forth in the image forming apparatus 1 of the first embodiment, wherein a distance L between an intermediate transfer body 2 and fixing rollers 5A, 5B and a length Lp of a recording paper measured along a transporting direction satisfy a relation of L<Lp. According to the ninth embodiment, a change in speed of the intermediate transfer body 2 can be suppressed as in the first embodiment and a size of the apparatus can be compact.

Figure 12:
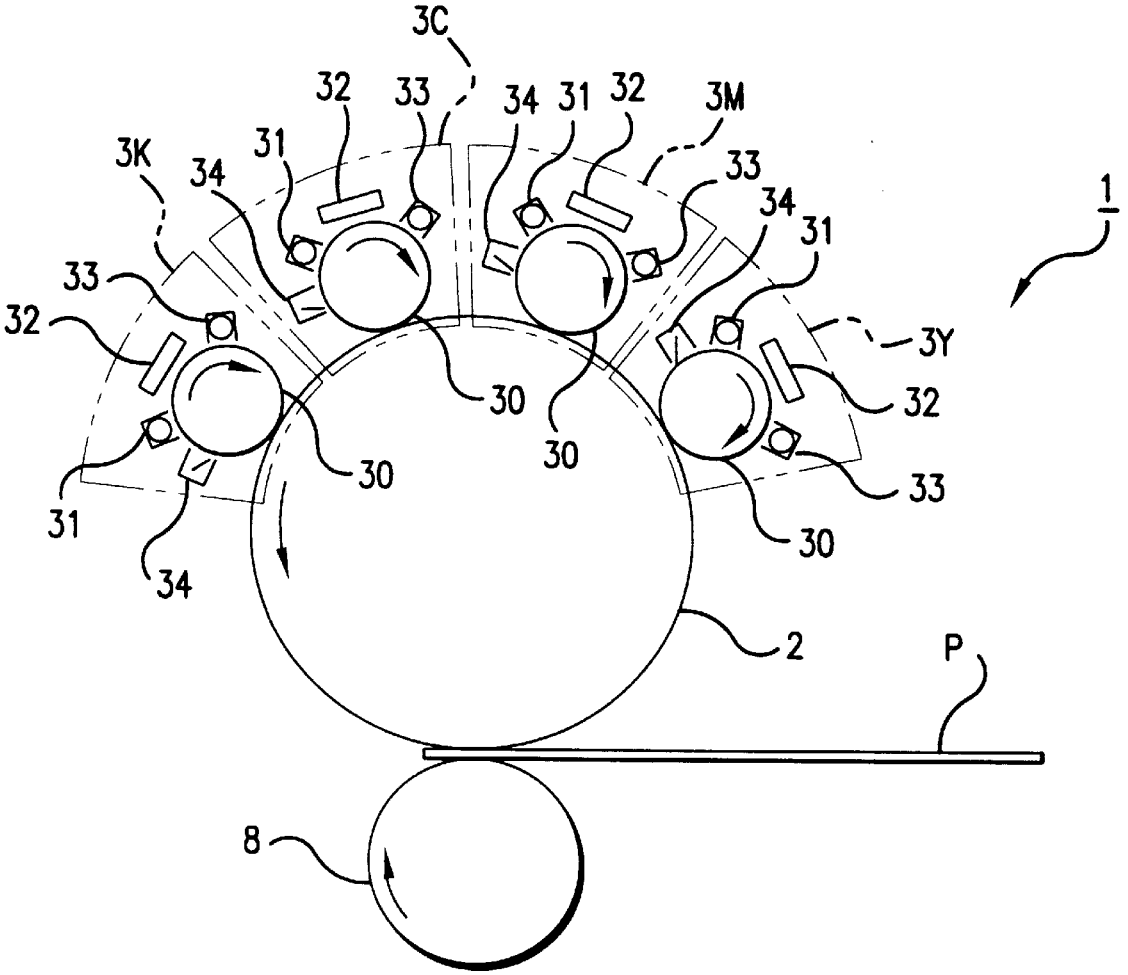
FIG. 12 is a view showing a structure of an image forming apparatus according to a tenth embodiment of the present invention.

FIG. 12 shows a tenth embodiment of the present invention. The image forming apparatus 1 is an image forming apparatus set forth in the image forming apparatus of the first embodiment, wherein a transfer/fixing roller 8, which is used for simultaneously transferring and fixing of a color toner image on an intermediate transfer body 2 to a recording paper P is installed instead of the transfer roller 4, and the other constituents are same as those of the first embodiment. According to the tenth embodiment, a change in speed of the intermediate transfer body 2 can be suppressed in a similar manner to the first embodiment and simplification and a smaller size of the structure can be achieved.

In the means time, the present invention is not limited to the above described embodiments but various other embodiments can be available. For example, in the first and sixth to eighth embodiments, there may be adopted such a structure as a distance L between the intermediate transfer body 2 and the fixing rollers 5A, 5B and a length of a recording paper P measured along a transporting direction Lp satisfy a relation of L<Lp in a similar manner to the ninth embodiment. In addition, in the first and sixth to eighth embodiments, the transfer roller 4 and the fixing rollers 5A, 5B may be replaced with the transfer/fixing roller 8 as in the tenth embodiment.

As has been described above, according to an image forming apparatus of the present invention, since a constant rotation load is imposed on an intermediate transfer body or a drive means for driving the intermediate transfer body to rotate, impulsive or constant changes in speed of the intermediate transfer body and a photosensitive body can be suppressed even if changes arise in torque load of the intermediate transfer body and the photosensitive body, so that a high quality image without density unevenness, color misalignment, a smear or the like can be produced.

Further, since changes in speed of the intermediate transfer body and the photosensitive body can be suppressed without use of a fly-wheel, there can be avoided problems of increase in the apparatus's structure and increase in power consumption. Furthermore, since a constant rotation load is imposed on the intermediate transfer body or the drive means therefor, a higher degree df complexity in structure of the apparatus can be prevented from occurring even in the case where a color image forming apparatus of a tandem type using a plurality of photosensitive bodies is adopted.

What is claimed is:

1. An image forming apparatus comprising:

an image carrier;

electrostatic latent image forming means for forming an electrostatic latent image on a surface of said image carrier;

developing means for developing said electrostatic latent image formed on said image carrier with toner to form a toner image;

an intermediate transfer body rotatably supported;

drive means for driving said intermediate transfer body;

transfer means for transferring said toner image to said intermediate transfer body;

rotation load imposing means for imposing a rotation load to said intermediate transfer body or said drive means to suppress a change in speed of said intermediate transfer body;

detecting means for detecting a change in rotation torque of said intermediate transfer body; and setting means for setting said rotation load based on said change in rotation torque.

2. The image forming apparatus according to claim 1, further comprising:

a second transfer means for transferring said toner image to a recording medium at a predetermined second transfer position; and a fixing means for fixing said toner image transferred on said recording medium by said second transfer means, wherein the fixing means is disposed from said second transfer means by a predetermined distance.

3. The image forming apparatus according to claim 2, wherein said fixing means is disposed from said second transfer means a distance which is longer than a length of said recording medium in a transporting direction.

4. The image forming apparatus according to claim 2, wherein said fixing means is disposed from said second transfer means a distance which is shorter than a length of said recording medium in a transporting direction.

5. The image forming apparatus according to claim 1, further comprising:

transfer/fixing means for simultaneously transferring and fixing said toner image to said recording medium.

6. The image forming apparatus according to claim 1, wherein said rotation load imposing means makes said rotation load larger than a maximum of an absolute value of said change in rotation torque of said intermediate transfer body.

7. An image forming apparatus comprising:

an image carrier:

electrostatic latent image forming means for forming an electrostatic latent image on a surface of said image carrier;

developing means for developing said electrostatic latent image formed on said image carrier with toner to form a toner image;

an intermediate transfer body rotatably supported;

drive means for driving said intermediate transfer body;

transfer means for transferring said toner image to said intermediate transfer body;

rotation load imposing means for imposing a rotation load to said intermediate transfer body or said drive means to suppress a change in speed of said intermediate transfer body;

wherein the rotation load imposing means comprises:

detecting means for a change in rotation torque of said intermediate transfer body; and setting means for setting said rotation load at a value larger than the maximum of an absolute value of said change in rotation torque based on said change in rotation torque detected by said detecting means.

8. The image forming apparatus according to claim 1, wherein said rotation load imposing means imposes said rotation load on a non-image forming portion of said intermediate transfer body in the shape of a drum or on a drive roller for said intermediate transfer body in the shape of a belt, in a rubbing and contact condition.

9. The image forming apparatus according to claim 1, wherein said rotation load imposing means imposes said rotation load by use of a high viscosity damper.

10. The image forming apparatus according to claim 1, wherein said rotation load imposing means imposes said rotation load by use of a magnet.

11. The image forming apparatus according to claim 1, wherein said rotation load imposing means imposes said rotation load by use of an electromagnetic brake.

12. An image forming apparatus comprising:

an image carrier;

electrostatic latent image forming means for forming an electrostatic latent image on the surface of said image carrier;

developing means for developing said electrostatic latent image formed on said image carrier with toner to form a toner image;

an intermediate transfer body rotatably supported;

drive means for driving said intermediate transfer body;

transfer means for transferring said toner image to said intermediate transfer body; and rotation load imposing means for imposing a constant rotation load to said intermediate transfer body or said drive means to suppress a change in speed of said intermediate transfer body;

wherein said rotation load imposing means comprises a member selected from the group consisting of a high viscosity damper, magnet and electromagnetic brake.

13. The image forming apparatus according to claim 12, wherein said rotation load imposing means imposes said rotation load by use of a high viscosity damper.

14. The image forming apparatus according to claim 12, wherein said rotation load imposing means imposes said rotation load by use of a magnet.

15. The image forming apparatus according to claim 12, wherein said rotation load imposing means imposes said rotation load by use of an electromagnetic brake.

16. The image forming apparatus according to claim 12, further comprising:

a second transfer means for transferring said toner image to a recording medium at a predetermined second transfer position; and a fixing means for fixing said toner image transferred on said recording medium by said second transfer means, wherein the fixing means is disposed from said second transfer means by a predetermined distance.

17. The image forming apparatus according to claim 16, wherein said fixing means is disposed from second transfer means a distance which is longer than a length of said recording medium in a transporting direction.

18. The image forming apparatus according to claim 16, wherein said fixing means is disposed from said second transfer means a distance which is shorter than a length of said recording medium in a transporting direction.

19. The image forming apparatus according to claim 12, further comprising:

transfer/fixing means for simultaneously transferring and fixing said toner image to a recording medium.

20. The image forming apparatus according to claim 12, wherein said rotation load imposing means makes said rotation load larger than a maximum of an absolute value of a change in rotation torque of said intermediate transfer body.

* * * * *